US006502590B1

(12) United States Patent
DeBartolo et al.

(10) Patent No.: US 6,502,590 B1
(45) Date of Patent: Jan. 7, 2003

(54) METHOD AND APPARATUS FOR FLUSHING X-RAY TUBE HEAT EXCHANGER

(75) Inventors: Michael M. DeBartolo, Elk Grove Village, IL (US); Kenneth A. Biliskov, Plainfield, IL (US); Qing K. Lu, Aurora, IL (US)

(73) Assignee: Koninklijke Philips Electronics N.V. (NL)

( * ) Notice: Subject to any disclaimer, the term of this patent is extended or adjusted under 35 U.S.C. 154(b) by 63 days.

(21) Appl. No.: 09/652,882

(22) Filed: Aug. 31, 2000

(51) Int. Cl.[7] ..... B08B 3/04

(52) U.S. Cl. ..... 134/168 C; 134/169 C; 134/103.1

(58) Field of Search ..... 134/168 C, 167 C, 134/169 C, 166 C, 103.1, 22.1, 22.11, 22.12, 22.18

(56) References Cited

U.S. PATENT DOCUMENTS 1,865,289 A * 6/1932 Trowbridge
2,619,974 A * 12/1952 Daley et al.
3,119,399 A * 1/1964 Bender
3,278,961 A * 10/1966 Sevensson
3,435,834 A * 4/1969 Cooper
3,536,081 A * 10/1970 Riess
3,618,621 A * 11/1971 Nordegren
4,161,979 A * 7/1979 Stearns
4,527,515 A * 7/1985 Hester, II
4,693,305 A 9/1987 Fujimoto et al.
4,846,259 A 7/1989 Fujimoto et al.
4,878,517 A * 11/1989 Prange
5,007,444 A * 4/1991 Sundholm
5,640,734 A 6/1997 Kuwashima
5,680,877 A * 10/1997 Edstrand et al.
6,328,812 B1 * 12/2001 Huang

* cited by examiner

*Primary Examiner*—Frankie L. Stinson
(74) *Attorney, Agent, or Firm*—Eugene E. Clair

(57) ABSTRACT

A method for cleaning the interior of a heat exchanger includes connecting the heat exchanger (25*a–e*) to a fluid supply (26) and fluid delivery system (24). Fluid flow is provided from the fluid supply (26) through the interior of the heat exchanger (25*a*) in a first direction. The fluid flow is pulsed a predetermined number of times to change the pressure within the heat exchanger. The fluid flow is then pulsed a plurality of times through the heat exchanger in a second direction.

9 Claims, 1 Drawing Sheet

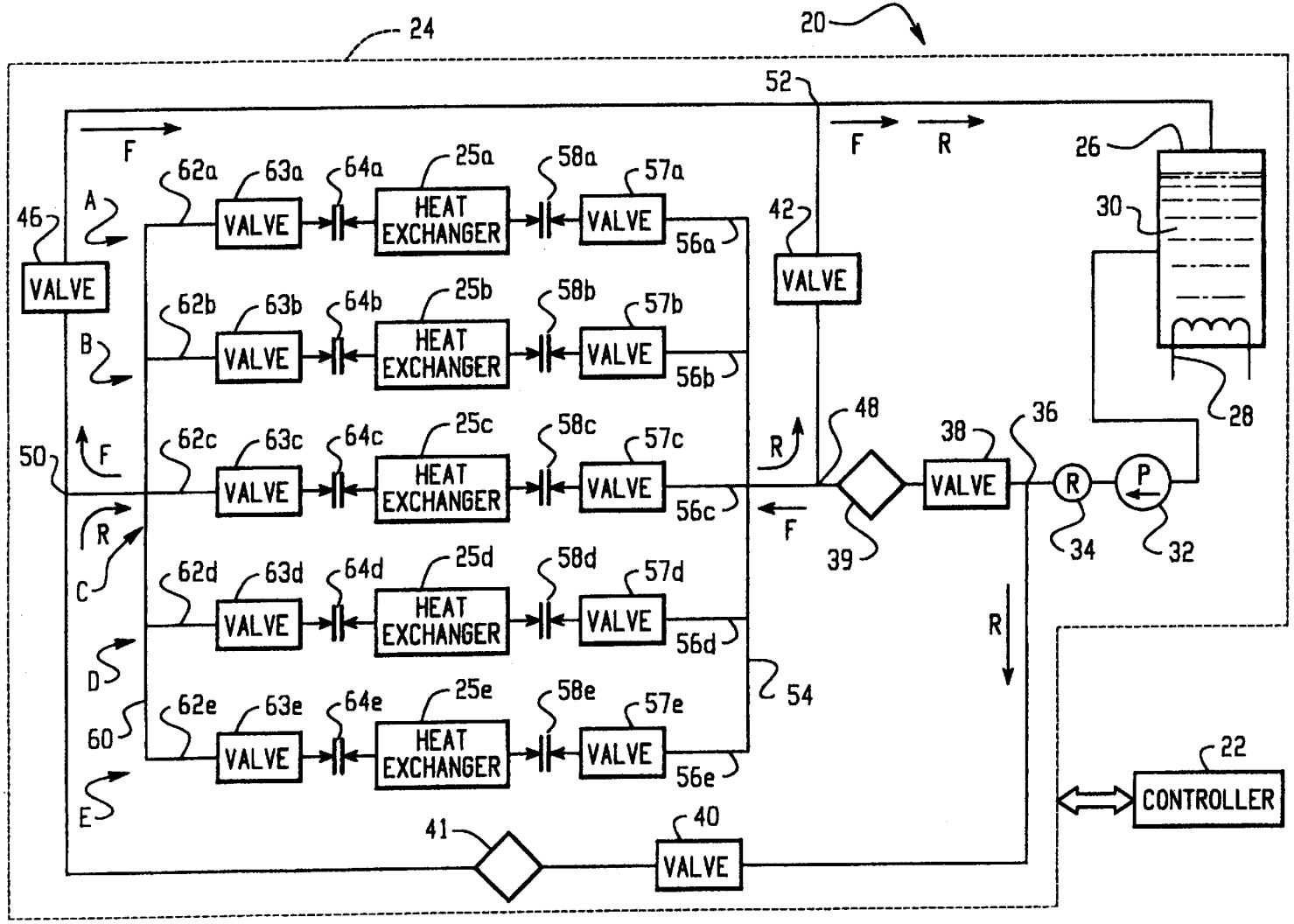
CONTROLLER
22
20
24
26
28
30
32
34
36
38
39
40
41
42
46
48
50
52
54
60
VALVE
HEAT EXCHANGER
F
R
A
B
C
D
E

METHOD AND APPARATUS FOR FLUSHING X-RAY TUBE HEAT EXCHANGER

BACKGROUND

The present invention relates to cleaning heat exchangers and is particularly related to a method and apparatus for cleaning contaminants and particulates from the interior surfaces of the heat exchanger. The present invention finds particular application in conjunction with heat exchangers for x-ray tubes and will be described with particular respect thereto.

X-ray tubes require high voltage electrical connections to operate. In addition, considerable heat is produced during the generation of x-rays. To facilitate reliable high voltage connections and cooling, the x-ray tube is enclosed in a housing. The housing includes suitable high voltage connections for tube operation and defines a cavity to provide for circulation of a cooling fluid around the x-ray tube. The cooling fluid, for example dialla oil, is pumped into the housing through an input port, circulates around the x-ray tube removing heat, exits the housing and passes through a heat exchanger to cool the fluid.

Since the cooling fluid is circulated around high voltage components of the x-ray tube, contaminants and particles that are suspended in the fluid can result in arcing within the x-ray tube housing. Such arcing has a deleterious effect on the x-ray tube system. The contaminants and particles oftentimes are present as a consequence of the manufacturing process for the heat exchanger.

In an operating x-ray tube installed in an imaging system, if the cooling fluid is overheated during generation of x-rays, carbon deposits can develop within the fluid circuit and deposit on the interior surfaces within the cooling system, including the inner walls of the heat exchanger tubing. These deposits can later be dislodged from the heat exchanger and circulate around the high voltage components within the housing. These contaminants can also be the source of arcing. Heat exchangers removed from operating units in the field are often reconditioned and reused. Thus, it is important to remove particulates and contaminants from the interior surfaces of the heat exchanger that may accumulate during the operation of the system in the field.

In an effort to clean new and reconditioned heat exchangers, the heat exchangers are usually flushed with heated fluid at x-ray tube system operating pressure of approximately 5 pounds per square inch. Some other methods of cleaning heat exchangers, used in other commercial or industrial applications, are not suitable for use in the x-ray tube environment. For example, some heat exchangers are cleaned by steam, solvents, aqueous solutions or by forcing brushes through the interior of the cooling tubing. Each of these methods has at least some of the following disadvantages: (i) contamination by condensation within the heat exchanger, (ii) difficulty in disposal of hazardous chemicals and (iii) insufficient cleaning and (iv) damaging the interior cooling tube surfaces. For at least these reasons, methods used to clean heat exchangers for other applications are not suitable for use in conjunction with high voltage x-ray tube cooling systems.

SUMMARY OF THE INVENTION

The present invention is directed to a method and apparatus that satisfies the need to provide for cleaning x-ray tube heat exchangers which is compatible with the unique operating environment in which the heat exchanger and associated cooling fluid operate. A method in accordance with one embodiment of the present invention includes connecting the heat exchanger to a fluid supply and delivery system. Fluid flow is provided from the fluid supply through the interior of the heat exchanger in a first direction. The fluid flow is pulsed a predetermined number of times to suddenly change the fluid pressure within the heat exchanger. The fluid flow is then pulsed a plurality of times through the heat exchanger in a second direction.

In accordance with another aspect of the invention, an apparatus for cleaning the interior of a heat exchanger includes a source of fluid and a fluid delivery system in fluid communication with the source of fluid. The fluid delivery system is connectable to provide fluid through the interior of the heat exchanger. A pump moves the fluid through the fluid delivery system. A valve is operatively connected to the fluid delivery system to control fluid flow to the heat exchanger. A controller is controllably connected to the valve. The controller generates a control signal for suddenly varying the fluid flow through the heat exchanger over a predetermined period of time.

One advantage of the present invention is that the interior surfaces of the heat exchanger are more completely cleaned of particulate matter and contaminants.

The present invention provides the foregoing and other features hereinafter described and particularly pointed out in the claims. The following description and accompanying drawings set forth certain illustrative embodiments of the invention. It is to be appreciated that different embodiments of the invention may take form in various components and arrangements of components. These described embodiments being indicative of but a few of the various ways in which the principles of the invention may be employed. The drawings are only for the purpose of illustrating a preferred embodiment and are not to be construed as limiting the invention.

BRIEF DESCRIPTION OF THE DRAWINGS

The foregoing and other features and advantages of the present invention will become apparent to those skilled in the art to which the present invention relates upon consideration of the following detailed description of a preferred embodiment of the invention with reference to the accompanying drawings, wherein:

The FIGURE is directed to a schematic representation of an apparatus for applying the method and principles of the present invention.

DETAILED DESCRIPTION

With reference to FIG. 1, a preferred embodiment of a heat exchanger cleaning apparatus 20 applying the principles of the present invention is shown. The apparatus 20 includes a controller 22 and a fluid delivery system 24 operatively connected to heat exchangers 25*a*, 25*b*, 25*c*, 25*d*, 25*e*. The controller may be any suitable microprocessor based controller, micro-computer or Programmable Logic Controller. The fluid delivery system 24 provides fluid to the heat exchangers 25*a–e* to clean their interior surfaces. The controller 22 is operatively connected to controllable components of the fluid delivery system 24, as described in detail below.

The fluid delivery system 24 includes a fluid reservoir 26 connected to deliver fluid through a network of suitable tubing and/or hoses to a number of fluid handling, transporting, directing and flow control components. A heater 28 is provided to heat a fluid 30 contained in the reservoir 26. The fluid 30 is heated to lower its viscosity.

The reservoir 26 is in fluid communication with an input to a pump 32. The pump 32 provides sufficient system pressure for heat exchanger cleaning. A suitable pump is a 3HP Series 4900 centrifugal pump from Franklin Electric, 400 E. Spring Street, Bluffton, Ind. 46714. In this application, the pump is selected to provide 35 psi at the pump output and 15 gallons per minute into the fluid delivery system during a heat exchanger cleaning cycle. The reservoir 26 that supplies the pump 32 is maintained at a net positive suction head. The output of the pump 32 provides fluid to a regulator 30 for controlling pressure of the fluid 30 in the fluid delivery system e.g. the maximum pressure available and still within the pressure limits of the components in the fluid delivery system 24 or the heat exchangers 25*a–e*. As a result of pressure drops in the fluid delivery system 24 from the pump output to the heat exchangers, the pressure at the heat exchangers 25*a–e* is approximately 16 psi.

A fluid junction 36 provides for fluid flow from the reservoir 26 into a selected one of two fluid loops, both of which ultimately return the fluid to the reservoir 26. The first fluid loop, hereinafter referred to as forward flow, is shown by the arrows designated with the letter "F". A filter bank 39 having two filters rated at 5 microns is included in the forward flow loop to remove particulates suspended in the fluid. The second fluid loop, shown by the arrows designated with the letter "R", is hereinafter referred to as reverse flow. A filter bank 41 is also included in the reverse flow loop to remove particulates.

A plurality of fluid direction control valves 38, 40, 42 and 46 are interconnected and in fluid communication with various portions of the fluid delivery system 24 through a plurality of fluid junctions 48, 50, 52 and suitable interconnecting fluid conduits. The fluid direction control valves 38, 40, 42 and 46 are selectively opened and closed in desired combinations to direct the flow of fluid in the desired forward or reverse direction through the junctions 36, 48, 50 and 52, the heat exchangers 25*a–e* and interconnecting fluid conduits.

A forward flow header 54 is connected to the junction 48. A plurality of fluid flow branches A, B, C, D, E are connected to the forward flow header with fluid conduits 56*a–e* which extend in parallel from the forward flow header 54. Forward flow pulse control valves 57*a–e* are connected to their associated fluid conduits 56*a–e*. Fluid connectors 58*a–e* are provided to connect to their respective heat exchangers 25*a–e* into the respective branch A–E.

A reverse flow header 60 is connected to the junction 50. A plurality of fluid conduits 62*a–e* extend in parallel from the reverse flow header 60. Reverse flow pulse control valves 63*a–e* are connected to their associated fluid conduits 62*a–e*. Fluid connectors 64*a–e* are provided to connect to their respective heat exchangers 25*a–e* into the respective branch A–E.

The controller 22 is controllably connected to the pump 32, fluid direction control valves 38, 40, 42, 46, and fluid pulse control valves 57*a–e*, 63*a–e*. A suitable valve for the fluid direction control valves and pulse control valves is provided by Omega Technologies Company and identified as FSV 205. The valve is a solenoid valve with a viton seal and 1.25" NPT connector. The valve is designed for light oils and solvents and general operating range of 5 psi to 150 psi in temperatures up to 90° C. Omega technologies is located at One Omega Drive in Stamford, Conn. 06907.

Forward fluid flow in the "F" direction results when the fluid direction control valves 42 and 40 are closed and fluid direction control valves 38 and 46 are open. For example, if fluid is being directed through heat exchanger 25*a* in the forward direction, the fluid flows from open direction control valve 38 and filter 39 to the forward flow header 54, into branch "A", through the reverse flow header 60 to junction 50 and through the open valve 46 and junction 52 returning to the reservoir. Reverse fluid flow in the "R" direction through branch "A" results when the direction control valves 38 and 46 are closed and valves 40 and 42 are open. Fluid passes through the junction 36 and the open direction control valve 40. The fluid is directed through filter 41 and junction 50 into the reverse fluid flow header 60, into branch "A", through the forward flow header 54 and junction 48. From junction 48 the fluid passes through the open direction control valve 42, through the junction 52 and into the reservoir 26.

In the present invention, a new and different method and apparatus is provided to clean the interior surfaces of an x-ray tube heat exchanger using the pulse control valves 51*a–e* and 63*a–e* to control the fluid flow and fluid pressure through the heat exchangers. Specifically, the fluid flow is pulsed during the forward fluid flow direction and reverse fluid flow direction. The pulsating flow provides sudden pressure changes to mechanically strip particles away from the interior of the heat exchanger tubes. Once the particles are removed from the tube walls, they are filtered from the fluid.

The preferred process applying the principles of the present invention for cleaning heat exchangers begins by selecting one heat exchanger in a branch to be flushed by fluid in a cleaning cycle. The controller 22 sets the proper fluid direction control valves to provide the desired fluid flow direction, as described above. In addition, the appropriate fluid pulse control valves 57*a–e*, 63*a–e* are set and controlled for pulsed fluid flow in the desired branch, as described in more detail below. Generally, one cleaning cycle includes pulse controlled fluid flushing in the forward direction followed by pulse controlled fluid flushing in the reverse direction. Once the cleaning cycle for the first selected branch is completed, the valves are set to provide for flushing the next selected branch and the process is repeated individually for each of the remaining branches designated to receive a cleaning cycle. The cleaning cycle is similar for each branch A–E, thus, the process description with respect to branch "A" is similarly applicable for the remaining branches B–E.

Fluid flushing in the forward direction for branch "A" is initiated with the controller 22 setting the fluid direction control valves 38, 40, 42 and 46 for forward fluid flow as described above. The reverse fluid pulse control valve 63*a* is set to an open position and the forward fluid pulse control valve 57*a* is set to an initial open position. The remaining forward and reverse fluid pulse control valves 57*b–e* and 63*b–e* in the non-selected branches are set in a closed position by the controller 22 thereby preventing fluid flow. The controller 22 begins a timer to count down from 150 seconds for the duration of the forward fluid flush. At this time, fluid begins to flow freely at 16 psi and 15 gal/min through branch "A" and into the reservoir 26. At 120 seconds, the controller 22 provides a command signal to the forward fluid pulse control valve 57*a* to begin the first fluid pulse. At that time, the pulse control valve 57*a* closes suddenly causing a pressure change in the heat exchanger 25*a* and dislodging particles on the interior surfaces of the heat exchanger 25*a*. The pressure in the heat exchanger decreases to 0 psi and the fluid flow is 0 gal/min through the heat exchanger 25*a*. From 120 seconds to 114 seconds, the valve 57*a* gradually opens to its fully open position, again changing the pressure on the interior surfaces of the heat exchanger 25*a*. The pressure increases to 16 psi and the fluid flow is 15 gal/min. At 114 seconds the valve again closes suddenly and gradually opens to its fully open position at 108 seconds. The six second closing and opening pulse sequence is repeated seven times. After the seventh pulse, 78 seconds remain in the forward fluid flush. The fluid continues through the fluid delivery system 24 in the forward direction until the controller 22 counts down from 78 seconds to 0 seconds. Once the forward fluid flush pulse sequence is completed, the second portion of the cleaning cycle, the reverse fluid pulse sequence, is started.

Fluid flushing in the reverse direction for branch "A" is initiated with the controller 22 setting the fluid direction control valves 38, 40, 42 and 46 for reverse fluid flow as described above. The reverse fluid pulse control valve 63*a* is set to an initial open position and the forward fluid pulse control valve 57*a* is set to an open position. The remaining forward and reverse fluid pulse control valves 57*b–e* and 63*b–e* in the non-selected branches are set by the controller 22 in a closed position preventing fluid flow. The controller 22 starts the timer to count down from 150 seconds for the duration of the reverse fluid flush portion of the cleaning cycle. At this time, fluid flows freely at 16 psi and 15 gal/min through branch "A" in the reverse direction and into the reservoir 26. At 120 seconds, the controller 22 provides a command signal to the reverse fluid pulse control valve 63*a* to begin the first fluid pulse. At that time, the pulse control valve 63*a* closes suddenly causing a pressure change in the heat exchanger 25*a*, similar to that described above. From 120 seconds to 114 seconds, the valve 63*a* gradually opens to its fully open position, which changes the fluid pressure in the heat exchanger 25*a*. At 114 seconds the controller 22 provides a command signal to valve 63*a* which again closes suddenly and then gradually opens to its fully open position at 108 seconds. The six second closing and opening pulse sequence is repeated seven times. After the seventh pulse, 78 seconds remain in the reverse fluid flush. The fluid continues through the fluid delivery system in the reverse direction until the controller 22 counts down from 78 seconds to 0 seconds. Once the reverse fluid flush pulse sequence is completed, the second portion of the cleaning cycle, the reverse fluid pulse sequence, is completed. Once a full cleaning cycle for branch "A" is completed, the remaining branches are processed through the cleaning cycle.

A fluid flush pulse sequence having 0 to 4 pulses dislodges some additional particles from the interior walls when compared to conventional fluid flushing at x-ray tube imaging system operating pressure of 5 psi without any fluid pulses. In addition, the pulse duration can be varied between 4 seconds to 6 seconds to complete the valve closing to full valve open sequence. The efficiency of the flush sequence in dislodging particulate matter shows improvement at between 5 pulses per flushing sequence to 9 pulses per flushing sequence. For x-ray tube heat exchangers, the number of particles dislodged during the flushing sequence stabilizes at nine pulses per sequence.

While a particular feature of the invention may have been described above with respect to only one of the illustrated embodiments, such features may be combined with one or more other features of other embodiments, as may be desired and advantageous for any given particular application.

From the above description of the invention, those skilled in the art will perceive improvements, changes and modification. Such improvements, changes and modification within the skill of the art are intended to be covered by the appended claims.

Having described a preferred embodiment of the invention, the following is claimed:

1. An apparatus for cleaning an interior of an x-ray tube heat exchanger, the apparatus comprising:

a fluid flow system, the fluid flow system connected to the x-ray tube system heat exchanger;

a pump for moving the fluid through the fluid flow system;

a fluid flow control means for variably controlling the fluid flow; and a controller operatively connected to the fluid flow control means, the controller including fluid pulse control means for providing a plurality of fluid pulses in the heat exchanger, each of the pulses for a predetermined period of time, the controller generating a control signal to control the flow of fluid for the plurality of pulses to the heat exchanger.

2. The apparatus for cleaning the interior of the x-ray tube system heat exchanger of claim 1 wherein the fluid flow system including a means for controlling the direction of the flow of fluid for the plurality of pulses through the heat exchanger.

3. The apparatus for cleaning the interior of the x-ray tube system heat exchanger of claim 2 wherein the means for controlling the direction of fluid flow is a valve.

4. The apparatus for cleaning the interior of the x-ray tube system heat exchanger of claim 1 wherein the fluid control means includes a fluid pulse control valve.

5. The apparatus for cleaning the interior of the x-ray tube system heat exchanger of claim 1 including a fluid reservoir.

6. The apparatus for cleaning the interior of the x-ray tube system heat exchanger of claim 1 including a heating element for heating the fluid.

7. An apparatus for cleaning an interior of an x-ray tube system heat exchanger, the apparatus including:

a source of fluid;

a fluid delivery system in fluid communication with the source of fluid and connectable to provide fluid through the interior of the heat exchanger;

a pump for moving the fluid through the fluid delivery system;

a valve operatively connected to the fluid delivery system to control fluid flow to the heat exchanger; and a controller operatively connected to the valve, the controller including means for generating a control signal for a plurality of pulses for varying the pressure of the fluid flow through the x-ray tube system heat exchanger over each of the plurality of Pulses for a predetermined period of time.

8. The apparatus for cleaning the interior of the x-ray tube system heat exchanger of claim 7 including a plurality of valves in fluid communication with the fluid delivery system, the valves adapted to control the direction of fluid flow through the heat exchanger.

9. The apparatus for cleaning the interior of the x-ray tube system heat exchanger of claim 7 wherein the valve is adapted to suddenly vary the pressure of the fluid flow.

* * * * *